US006205677B1

(12) United States Patent
Yune

(10) Patent No.: US 6,205,677 B1
(45) Date of Patent: Mar. 27, 2001

(54) HALOGEN HAIR DRYER

(75) Inventor: Kyong Young Yune, Kyunggi-do (KR)

(73) Assignee: Shinheung Engineering Co., Ltd. (KR)

( * ) Notice: Subject to any disclaimer, the term of this patent is extended or adjusted under 35 U.S.C. 154(b) by 0 days.

(21) Appl. No.: 09/485,680

(22) PCT Filed: Jun. 25, 1999

(86) PCT No.: PCT/KR99/00336

§ 371 Date: May 18, 2000

§ 102(e) Date: May 18, 2000

(87) PCT Pub. No.: WO00/00055

PCT Pub. Date: Jan. 6, 2000

(30) Foreign Application Priority Data

Jun. 26, 1998 (KR) ..... 98/11251 U

(51) Int. Cl.[7] ..... F26B 3/34

(52) U.S. Cl. ..... 34/266; 34/96; 34/97; 392/385

(58) Field of Search ..... 34/266–269, 283, 34/96, 97; 392/380, 407, 409, 410; 132/200, 206, 211; 250/493.1, 503.1, 504 R, 504 H; 313/567, 578, 579

(56) References Cited

U.S. PATENT DOCUMENTS

| | | | | |
|---|---|---|---|---|
| 4,258,731 | * | 3/1981 | Tsujimoto et al. | 34/96 |
| 4,263,500 | * | 4/1981 | Springer et al. | 34/266 |
| 4,323,761 | | 4/1982 | Hubner | 219/377 |
| 4,382,174 | * | 5/1983 | Barns | 34/96 |
| 4,541,442 | * | 9/1985 | Hollmann et al. | 34/266 |
| 4,602,143 | * | 7/1986 | Mack et al. | 34/266 |
| 4,691,451 | * | 9/1987 | Giorgis | 34/96 |
| 4,797,535 | * | 1/1989 | Martin | 219/338 |
| 4,910,382 | * | 3/1990 | Kakuya et al. | 34/97 |
| 4,914,273 | * | 4/1990 | Matsui | 34/266 |
| 4,952,944 | * | 8/1990 | Inui et al. | 346/25 |
| 4,965,434 | * | 10/1990 | Nomura et al. | 392/407 |
| 5,231,770 | * | 8/1993 | Fertig | 34/266 |
| 5,300,097 | * | 4/1994 | Lerner et al. | 607/93 |
| 5,403,434 | * | 4/1995 | Moslehi | 156/643 |
| 5,568,586 | * | 10/1996 | Junkel | 392/376 |
| 5,621,847 | * | 4/1997 | Tillotson et al. | 392/391 |
| 5,714,119 | * | 2/1998 | Kawagoe et al. | 422/21 |
| 5,715,361 | * | 2/1998 | Moslehi | 392/416 |
| 5,719,493 | * | 2/1998 | Higashi et al. | 323/908 |
| 5,770,835 | * | 6/1998 | Sakuyama et al. | 219/388 |
| 5,889,258 | * | 3/1999 | Lubomirski et al. | 219/405 |
| 6,026,821 | * | 2/2000 | Last | 132/200 |

FOREIGN PATENT DOCUMENTS

| | | | | |
|---|---|---|---|---|
| 3927-264 | * | 3/1990 | (DE) | 34/267 |

OTHER PUBLICATIONS

Hall, James D. "Radiant Heat and Its Application." Annual Meeting of the Technical Association of the Pulp & Paper Industry. Feb. 1942. Cl. 34 Subcl. 268.*

* cited by examiner

*Primary Examiner*—Pamela Wilson
(74) *Attorney, Agent, or Firm*—Bacon & Thomas PLLC

(57) ABSTRACT

A hair dryer is provided which dries hair by convection and infrared radiation heating. The dryer includes a hand grip extending downward, an intake opening and an exhaust opening, and a halogen heater comprising a U-shaped quartz tube with a tungsten filament. Infrared radiation is emitted by the quartz tube and a fan is rotated by a motor which causes air from the air intake opening to flow past the halogen heater to heats an air stream that is discharged from the exhaust opening.

2 Claims, 2 Drawing Sheets

HALOGEN HAIR DRYER

FIELD OF THE INVENTION

The present invention relates to a halogen hair dryer, and more specifically to a new halogen hair dryer which could treat hair in a combined way of convection heating and infrared radiation heating

BACKGROUND OF THE INVENTION

Generally, the hair dryer is used to dry up the hair by heated air flow generated by heat wire such as Ni—Cr alloy wire. FIG. 1 shows the conventional hair dryer, comprising of body(8) which has hand grip(2) extending downward, an intake opening(4) and an exhaust opening(6) on the opposite side of it, a fan(11) driven by motor(10), a heat wire(9) disposed in front of fan(11) and a switch button(12) on the hand grip(2).

The user will press the switch button(12) to operate the motor(10) and the heat wire(9) to exhaust the heated air through the exhaust opening(6). But, because this type hair dryer may dry up the hair only by heat convection, the surface of hair may be easily heated, but the inner part of hair would not be sufficiently heated in a short time. And, if we heat the hair for long time enough to dry up into the inner part of hair, the hairline may be damaged by long time exposure of heated air. In addition, as the energy efficiency of heat wire is relatively low, the energy consumption is considerably high.

SUMMARY OF THE INVENTION

The invention is suggested to solve the above mentioned problems and the object of the invention is to provide a new type of hair dryer having a halogen heater which may emit infrared and far-infrared radiations instead of conventional heat wire, and which may prevent the hair and head skin from being damaged and getting disease, and which may save the energy.

According to the invention, there is provided a halogen hair dryer which is comprised of a body(8) which has a hand grip(2) extending downward, an intake opening(4) and an exhaust opening(6) on the opposite side of it, a switch button(12) on the hand grip(2), a fan(11) driven by a motor(10) connected to the switch button(12) to intake the fresh air from the intake opening(4) and exhaust the heated air through the exhaust opening(6), a halogen heater(14) disposed in front of the fan(11) and connected to the switch button(12) and being capable of emitting a heated air flow and radiating an infrared and far-infrared ray, and an insulation material(20) around the halogen heater(14).

BRIEF DESCRIPTION THE DRAWINGS

DETAILED DESCRIPTION OF THE INVENTION

Figure 1:
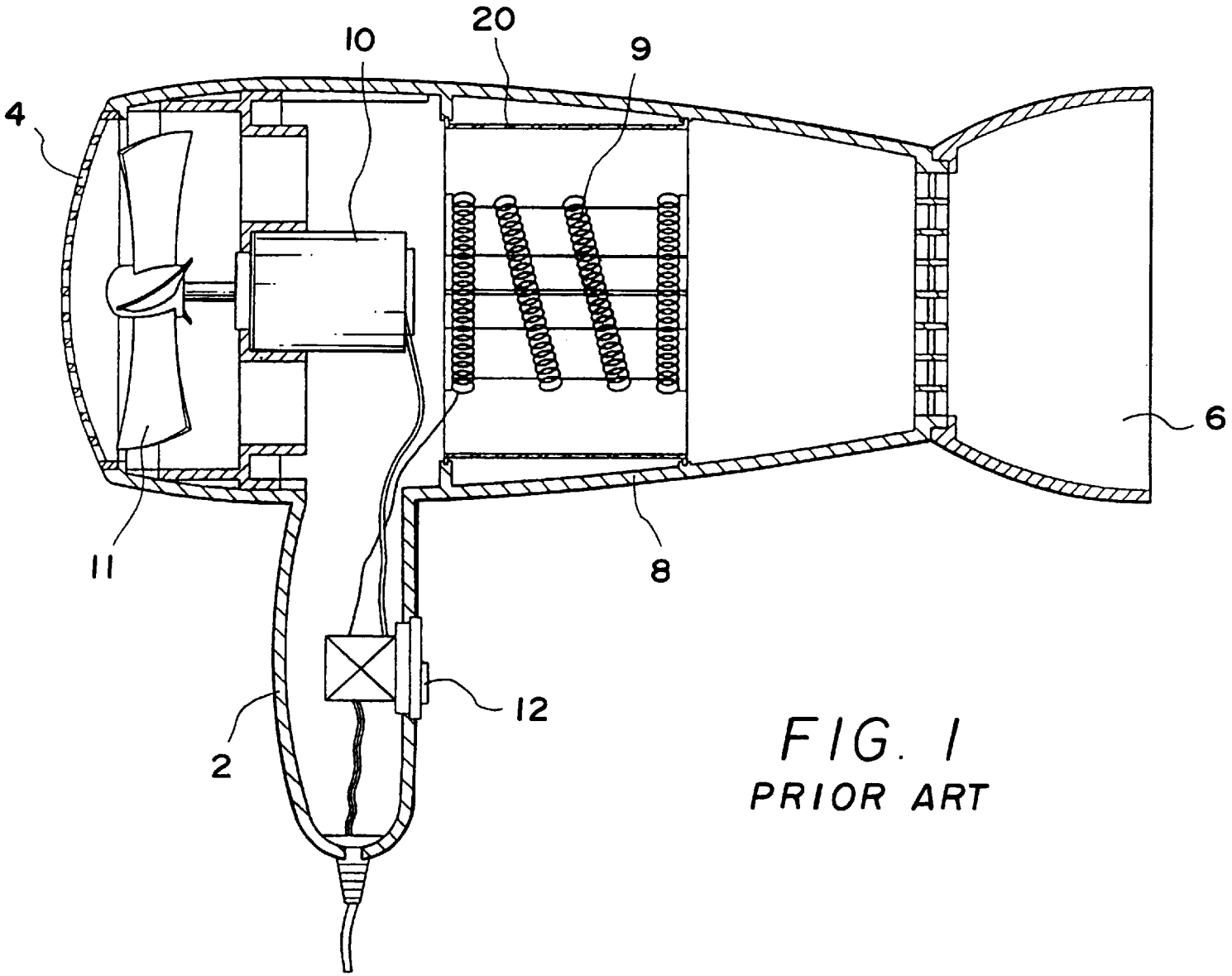
FIG. 1 PRIOR ART
FIG. 1 shows the conventional hair dryer.
Figure 2:
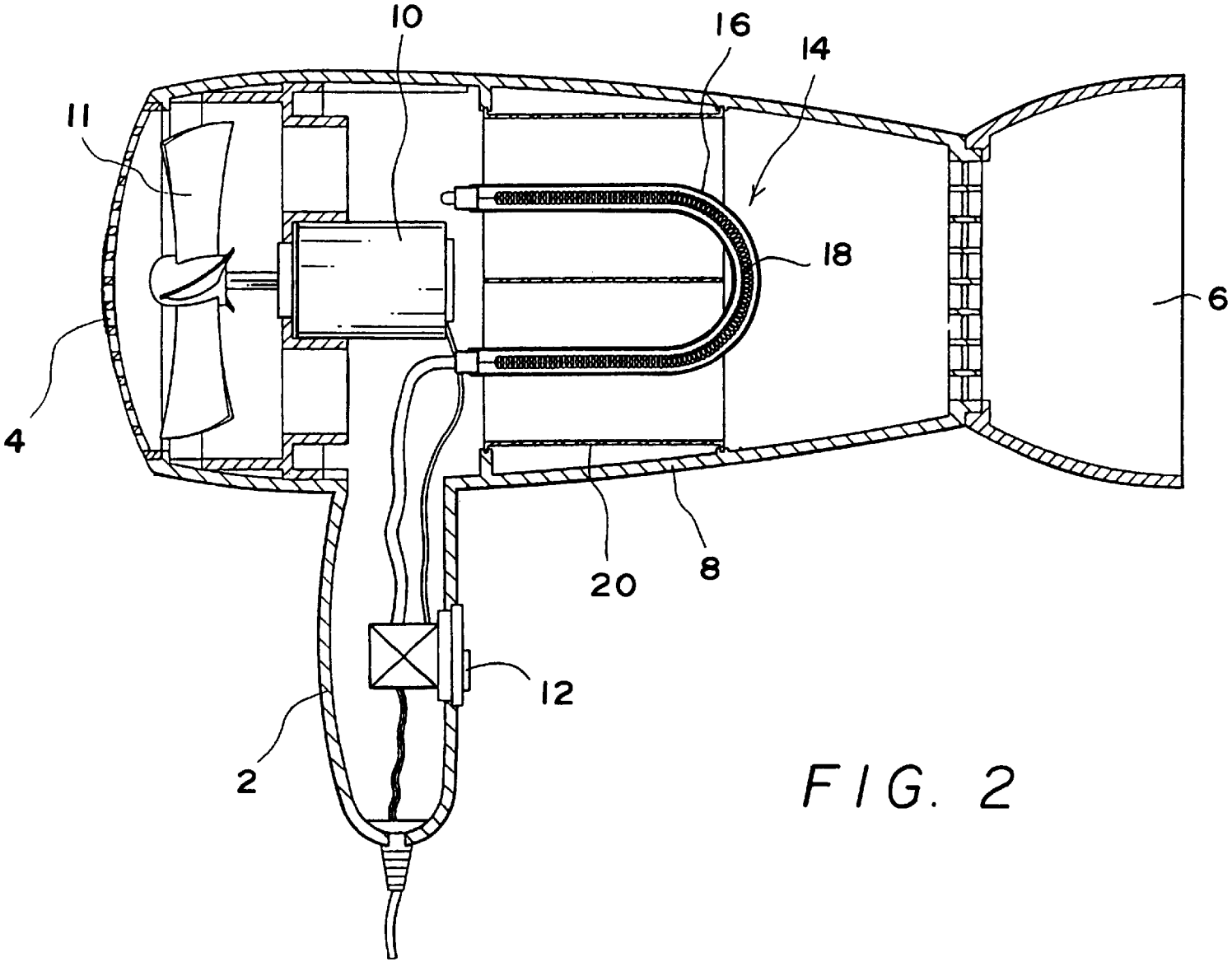
FIG. 2 shows the embodiment according to the invention.

Now, the present invention will be described below in detail based on the drawing. FIG. 1 shows an embodiment of the invention, in which the body(8) has a hand grip(2) extending downward from the body(8), and an intake opening(4) on the rear part of body(8) and an exhaust opening(6) on the front part of body(8). A switch button(12) is disposed on the hand grip(2). And, inside the body(8), there is provided with a fan(11) which is rotatable by the driving motor(10) connected to switch button(12). The fan (11) may intake the fresh air from the intake opening(4) and exhaust the heated air through the exhaust opening(6). And, a halogen heater(14) is disposed in front of the fan(11).

The halogen heater(14) is electrically connected to the switch button(12) and, in operation, emits a lot of heat and infrared radiations. The halogen heater(14) is made by bending the quartz glass tube(16) into U form, and inert gases such as nitrogen or argon, and halogen materials such as iodine, bromine and chlorine are entered into it and sealed. Owing to the reaction between the tungsten of filament(18) and the halogen materials (halogen recycle mechanism), the filament(18) would not be easily worn out, and it will emit considerable amount of heat with less electricity energy consumption.

In order to emit more heat rather than light, the length of filament(18) of the halogen heater(14) should be made longer and the thickness of it should be made thicker than those which are used in ordinary halogen lamp. And, some infrared radiation materials can be coated on the surface of the quartz glass tube(16) to enhance the infrared radiation. And around the halogen heater(14), a heat insulating material(20) such as ceramic compositions of $SiO_2$, $Al_2O_3$ or $FeO_2$, is disposed to prevent the body(8) from being heated or melted.

Accordingly, if the switch button(12) is pressed, the fan(11) starts to rotate and the halogen heater(14) will emit the heat and infrared radiation, then, the heated air will flow through the exhaust opening(6) by fan(11). Additionally, the infrared ray generated from the halogen heater(14) will radiate through the exhaust opening(6) to heat the object in front of the exhaust opening(6). The infrared ray is of high permeability that it could transport the heat into the inner part of hair, to which the heated air could not easily reached by convection only. Therefore, if the halogen hair dryer of the invention is used, the hair will be dried up quickly. And, the far-infrared ray generated from the halogen heater(14) will effect advantageously to the health of hair, so diseases of head skin may be prevented.

The halogen hair dryer of the invention adopts t halogen heater(14) with higher energy efficiency than the conventional Ni—Cr heat wire, so that the consumption of electric power will be reduced to 30~40 percentage. Moreover, because the halogen hair dryer of the invention utilizes, as a heat transport means, the heat radiation of infrared ray as well as the heat convection of heated air flow, the inner part of hair will be easily heated and dried up quickly, to which the heated air may not easily reached by convection. Therefore, the drying efficiency will be considerably improved. And, hair protecting effect from the head skin disease will also be achieved by means of infrared radiation.

As mentioned above, the invention will provide a new type halogen hair dryer which utilizes halogen heater being capable of emitting the infrared and far-infrared radiation instead of conventional heat wire, so that the time needed to dry up hair should be reduced and energy consumption will also be reduced, and it will be able to keep the hair and the head skin being healthy.

What is claimed is:

1. A hair dryer comprising:

a housing having an air intake opening and an air exhaust opening;

a fan and a motor fixed inside the housing between said air intake opening and said air exhaust opening; and a halogen heater fixed inside said housing between said air exhaust opening and said fan, said halogen heater comprising an U-shaped quartz tube having a tungsten filament.

2. The hair dryer of claim 1, wherein the U-shaped quartz tube has a surface coated with an infrared radiation material.

* * * * *